US011980996B2

(12) United States Patent
Heuer et al.

(10) Patent No.: US 11,980,996 B2
(45) Date of Patent: May 14, 2024

(54) DEVICE AND METHOD FOR PRODUCING A CURVED LATERAL SURFACE ON A ROLLING ELEMENT

(71) Applicant: Schaeffler Technologies AG & Co. KG, Herzogenaurach (DE)

(72) Inventors: Werner Heuer, Vallendar (DE); Holger Paetzold, Burgebrach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 291 days.

(21) Appl. No.: 17/280,965

(22) PCT Filed: Oct. 16, 2019

(86) PCT No.: PCT/DE2019/100900
§ 371 (c)(1),
(2) Date: Mar. 29, 2021

(87) PCT Pub. No.: WO2020/078514
PCT Pub. Date: Apr. 23, 2020

(65) Prior Publication Data

US 2021/0354261 A1 Nov. 18, 2021

(30) Foreign Application Priority Data

Oct. 18, 2018 (DE) ..... 10 2018 125 825.9

(51) Int. Cl.
*B24B 5/26* (2006.01)
*B24B 41/06* (2012.01)

(52) U.S. Cl.
CPC ..... *B24B 5/26* (2013.01); *B24B 41/067* (2013.01)

(58) Field of Classification Search
CPC ..... B24B 5/26; B24B 41/067; B24B 5/04; B24B 5/18; B24B 5/307; B24B 53/081; B24B 5/37
See application file for complete search history.

(56) References Cited

U.S. PATENT DOCUMENTS

| | | | |
|---|---|---|---|
| 2,409,320 | A | 10/1946 | Spicacci |
| 2,795,900 | A | 6/1957 | Modler |
| 2,930,373 | A | 3/1960 | Jessup et al. |
| 3,664,067 | A | 5/1972 | Beauchet |

(Continued)

FOREIGN PATENT DOCUMENTS

| | | |
|---|---|---|
| CN | 103821828 | 5/2014 |
| CN | 105033786 | 11/2015 |
| CN | 106181678 A | 12/2016 |

(Continued)

*Primary Examiner* — Rick K Chang

(57) ABSTRACT

A device for producing a curved lateral surface on a rolling element for a rolling bearing includes a grinding apparatus for grinding the curved lateral surface and a retaining apparatus having a control wheel with a convexly profiled peripheral feeding surface for retaining the rolling element during the grinding. The retaining apparatus may include a plurality of control wheels. The control wheel or the convexly profiled peripheral feeding surface may be formed from a ceramic, a resin-bonded synthetic, or a metallic material. The device may include a dressing apparatus for profiling the convexly profiled peripheral feeding surface of the control wheel.

12 Claims, 3 Drawing Sheets

(56) References Cited

U.S. PATENT DOCUMENTS

2006/0228990 A1* 10/2006 James ..... B24B 5/37
451/49

FOREIGN PATENT DOCUMENTS

| | | | |
|---|---|---|---|
| DE | 517148 | | 1/1931 |
| DE | 1179826 | | 10/1964 |
| GB | 1024772 | A | 4/1966 |
| JP | S48674 | B | 1/1973 |
| JP | S197348674 | A | 1/1973 |
| JP | 2002059345 | A | 2/2002 |
| JP | 2003089043 | A | 3/2003 |
| WO | 2020024879 | A1 | 2/2020 |

* cited by examiner

DEVICE AND METHOD FOR PRODUCING A CURVED LATERAL SURFACE ON A ROLLING ELEMENT

CROSS-REFERENCE TO RELATED APPLICATIONS

This application is the United States National Phase of PCT Appln. No. PCT/DE2019/100900 filed Oct. 16, 2019, which claims priority to German Application No. DE102018125825.9 filed Oct. 18, 2018, the entire disclosures of which are incorporated by reference herein.

TECHNICAL FIELD

The disclosure relates to a device for producing a curved lateral surface on a rolling element for a rolling element bearing. The disclosure also relates to a method for processing at least one control wheel of the device.

BACKGROUND

The lateral surfaces of rolling elements, such as rollers, are usually processed by grinding. It is known to use a grinding apparatus with a curved grinding surface for grinding, for example, as disclosed in document CN 103 821 828 A.

For the production of needle rollers with a curved lateral surface, it is proposed in document CN 105 033 786 A to arrange the needle rollers on a curved plate and to grind them.

It is also known to arrange a tapered roller on a so-called hump wheel and thereby feed it to a grinding wheel for grinding a curved lateral surface.

SUMMARY

The disclosure provides an alternative device and an alternative method for producing a curved lateral surface on a rolling element. This disclosure includes a device, a method for producing the curved lateral surface, and a method for processing a control wheel of the device.

A device is proposed which is designed to produce a curved, e.g., crowned, lateral surface on a rolling element for a rolling element bearing. The rolling element may be designed as a tapered roller which can be integrated in a tapered roller bearing.

The device includes a grinding apparatus designed to grind the curved lateral surface on the rolling element. The grinding apparatus may be designed as a grinding wheel having a concavely profiled peripheral grinding surface.

Furthermore, the device includes a retaining apparatus designed to retain the rolling element for and/or during a grinding by the grinding apparatus. In addition, the retaining apparatus may be designed for feeding the rolling element to the grinding apparatus.

The retaining apparatus is designed as a control wheel having a convexly profiled peripheral feeding surface. The device may have a plurality of control wheels arranged to be adjacent to one another and/or connected to one another in a rotationally fixed manner for the simultaneous production of a plurality of rolling elements with the curved lateral surface.

When the tapered roller is arranged on a so-called hump wheel as a retaining apparatus for grinding the lateral surface, a possible curvature or crowning of the lateral surface, e.g., due to the weight of the tapered roller, is limited in terms of production technology. As a result, the tapered roller can only be produced with geometric restrictions.

The convexly profiled peripheral feeding surface of the disclosed control wheel reduces and/or overcomes these restrictions when the rolling element is arranged on the convexly profiled peripheral feeding surface to grind the lateral surface in a curved manner.

For example, the control wheel and/or the convexly profiled peripheral feeding surface is/are formed from a ceramic, synthetic resin-bonded, or metallic material. Therefore, the peripheral feeding surface, e.g., if it is formed from the ceramic or synthetic resin-bonded material, can be convexly profiled by a dressing apparatus of the device, for example, by one or more dressing apparatuses. For dressing the retaining apparatus, e.g., the control wheel, an example embodiment of the device includes a control apparatus which is designed to control the dressing apparatus. For example, the control apparatus can involve NC control.

The dressing apparatus is designed and provided to dress the grinding apparatus, for example, by profiling, calibrating, and/or sharpening the peripheral grinding surface of the grinding wheel in a concave manner. For example, the dressing apparatus is designed as a rotatable dressing roller or as a stationary dressing tool. Optionally, the dressing apparatus has a coating made of diamond or boron nitride (CBN), so that material can be removed from the retaining apparatus and on the grinding apparatus and the convex or concave profile can be introduced as a result.

Because the dressing apparatus is provided not only for dressing the grinding apparatus, but also for profiling the retaining apparatus, an additional processing machine for processing the peripheral feeding surface, e.g. a grinding or hard lathe, can be dispensed with. Complex handling of the control wheel from the additional processing machine to the device can thereby be avoided. This can consequently lead to cost savings.

In the event that the retaining apparatus, e.g., the control wheel, is formed from the metallic material, the convex profile may be made on the peripheral feeding surface of the at least one control wheel by wire electrical discharge machining.

The disclosure also includes a method for producing a curved, e.g., crowned, lateral surface on a rolling element for a rolling element bearing with the device according to the previous description.

As part of the method, the rolling element is arranged on the convexly profiled peripheral feeding surface of the at least one control wheel. The rolling element may be fed to the grinding apparatus in this way. The curved lateral surface is then ground, e.g., by means of the concavely profiled peripheral grinding surface of the grinding wheel. The control wheel and the grinding wheel may be rotated and/or rotate in opposite directions during the grinding of the curved lateral surface.

A method for processing the control wheel, as described in the previous description is also disclosed.

As part of the method, the peripheral feeding surface of the control wheel is processed and/or convexly profiled by the dressing apparatus of the device, if the control wheel and/or the peripheral feeding surface is/are formed from the ceramic or synthetic resin-bonded material for example. The control apparatus can control the dressing apparatus to convexly profile the peripheral feeding surface of the control wheel.

Alternatively, it is possible for the peripheral feeding surface of the control wheel to be processed by wire electrical discharge machining and/or to be convexly profiled when the control wheel and/or the peripheral feeding surface is/are formed from the metal-bonded material, for example.

BRIEF DESCRIPTION OF THE DRAWINGS

Further features, advantages and effects of the disclosure are set out in the following description of example embodiments of the disclosure. Therein.

DETAILED DESCRIPTION

Figure 1:
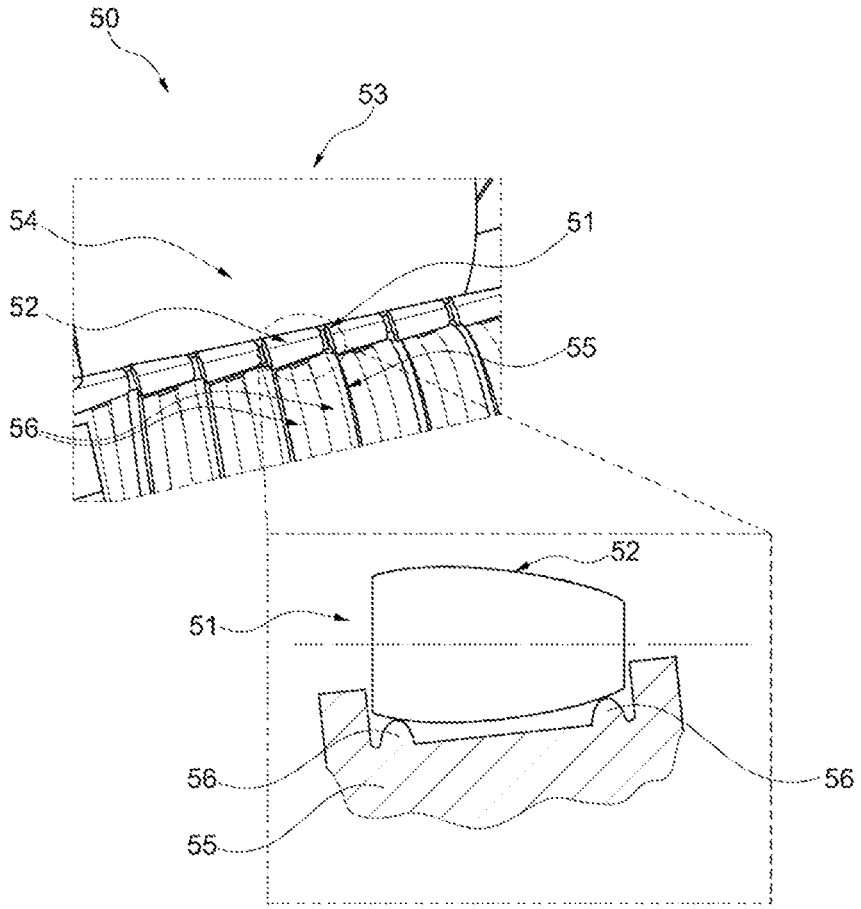
FIG. 1 shows a device from the prior art with a hump roller as a feeding and retaining device and a grinding apparatus for producing a tapered roller with a curved lateral surface.

FIG. 1 shows a device 50 from the prior art, which is designed to produce a curved, e.g., crowned, lateral surface 52 on a tapered roller 51. The device 50 includes a grinding apparatus 53 and a plurality of rotatable hump rollers 55, which are arranged to be adjacent to one another in a row and rotate together. Each hump roller 55 has in a longitudinal section two humps 56 on which the tapered roller 51 rests. The grinding apparatus 53 is designed as a rotatable grinding wheel having a grinding surface 54. The grinding wheel and the hump rollers 55 rotate in opposite directions.

Each hump roller 55 forms a retaining apparatus for exactly one tapered roller 51, which is arranged on the hump roller 55 and is thereby brought into contact with the grinding surface 54. The tapered roller 51 rotates with the hump roller 55 and is ground by the grinding surface 54 of the grinding wheel so that the curved lateral surface 52 is produced.

A producible curvature or crowning of the lateral surface 52 on the tapered roller 51 is limited in terms of production technology with the device 50 from the prior art, e.g., due to the arrangement on the hump roller 55 and due to a dead weight of the tapered roller. Therefore, geometric restrictions in the curvature or crowning of the lateral surface must be accepted.

Figure 2:
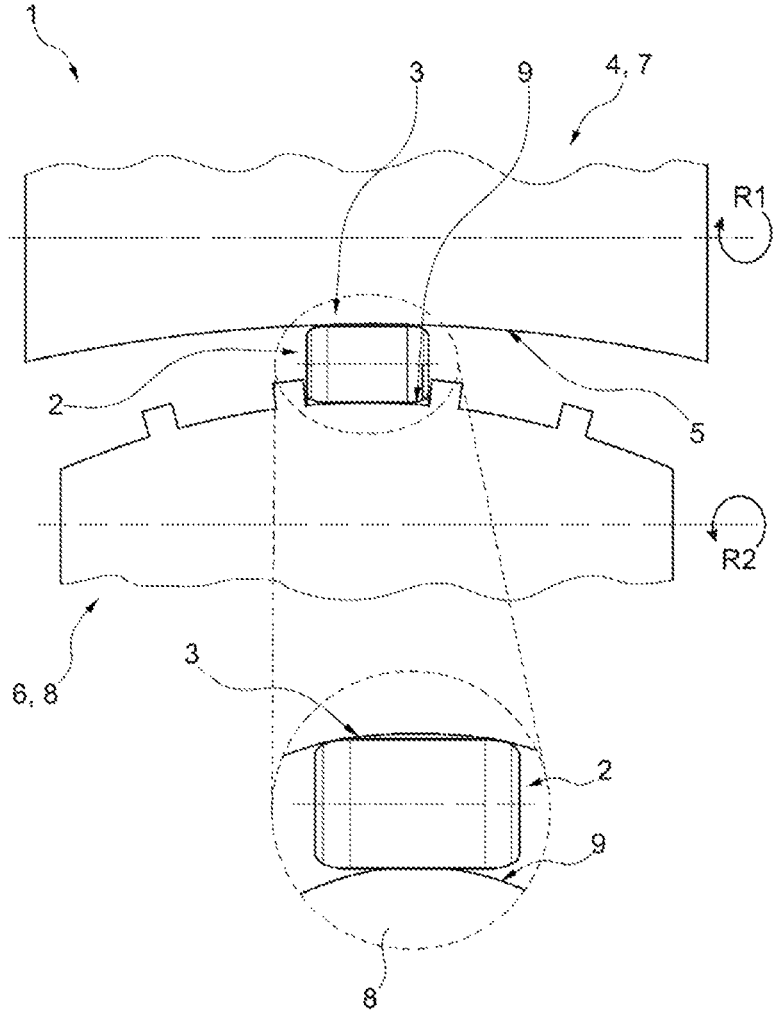
FIG. 2 shows a device with a control wheel as a feeding and retaining device and with a grinding apparatus for producing a rolling element with a curved lateral surface.

In FIG. 2, a device 1 is shown which is designed to produce a curved, e.g., crowned, lateral surface 3 on a rolling element 2 for a rolling element bearing. The rolling element is designed as a tapered roller 2. With the device 1, the production technology limitations of the device 50 from FIG. 1 can be reduced or even overcome.

The device 1 includes a grinding apparatus 4, which is designed as a grinding wheel 7 rotatable in a first direction of rotation R1. The grinding apparatus 4 has a concavely profiled peripheral grinding surface 5, with which the curved lateral surface 3 on the tapered roller 2 can be ground.

The device 1 includes a retaining apparatus 6 for retaining the tapered roller 2 during the grinding of the curved lateral surface 4.

The retaining apparatus 6 is designed as a plurality of rotatable control wheels 8 which are arranged to be adjacent to one another in a row. The control wheels are rotatably mounted and rotate together in a second direction of rotation R2, which is directed opposite to the first direction of rotation R1. Each control wheel 8 has a convexly profiled peripheral feeding surface 9 on which the tapered roller 2 can be arranged and mounted. Each control wheel 8 and/or each peripheral feeding surface 9 is formed from a ceramic, synthetic resin-bonded, or metallic material.

Due to the mounting on the convexly profiled peripheral feeding surface 9, the curved, e.g., crowned, lateral surface 3 on the tapered roller 2 can be produced with fewer geometric restrictions.

Figure 3:
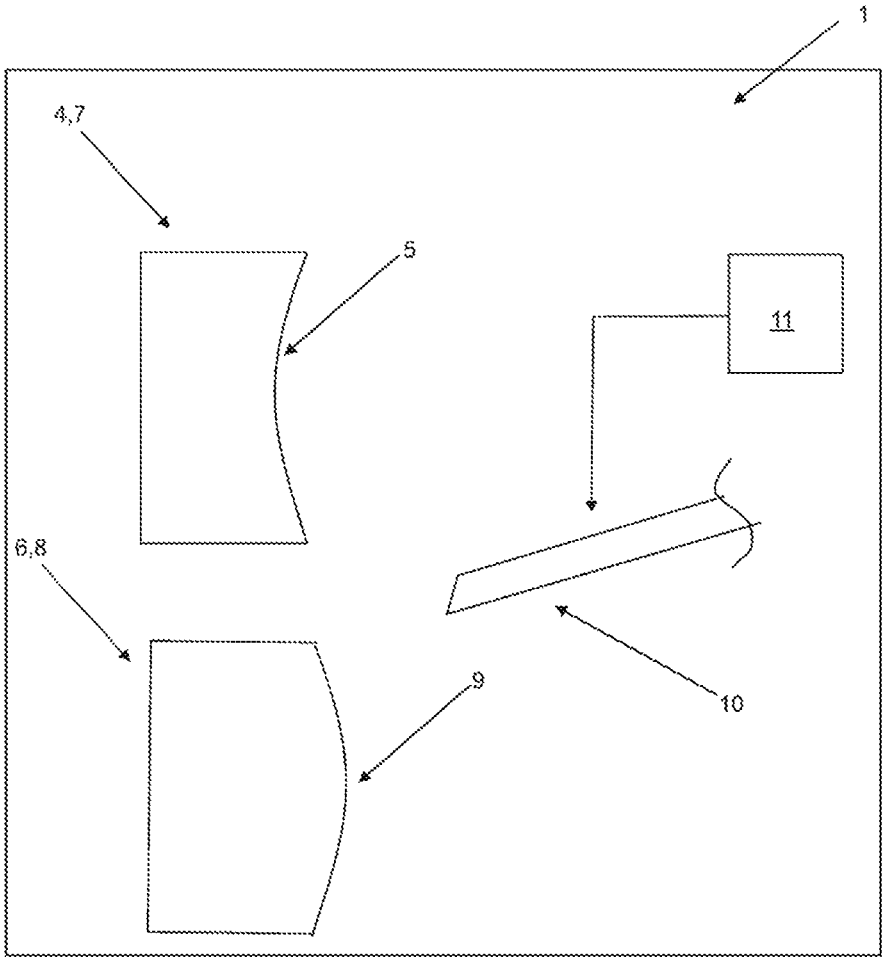
FIG. 3 shows a device includes a dressing apparatus for dressing a grinding apparatus and a retaining apparatus.

As shown in FIG. 3, the device 1 includes a dressing apparatus 10 for dressing the grinding apparatus 4 and the retaining apparatus 6. The dressing apparatus 10 is designed as a stationary dressing apparatus. Alternatively, it can be designed as a rotating dressing apparatus. The device 1 also includes a control apparatus 11 for controlling the dressing apparatus 10. The control apparatus 11 can be designed, for example, as an NC control.

The dressing apparatus 10 is provided to profile, sharpen, and/or calibrate the peripheral grinding surface 5 of the grinding wheel 7. To avoid dulling, this can also take place during the grinding of the lateral surface 3 of the tapered roller 2.

In addition, the dressing apparatus 10 is provided to convexly profile the peripheral feeding surface 9 of the control wheel 8, e.g., if the control wheel 8 and/or the peripheral feeding surface 9 is/are formed from the ceramic or synthetic resin-bonded material. The convex profiling of the peripheral feeding surface 9 by the dressing apparatus 10 takes place before the control wheel 8 is used in the device 1 as the retaining apparatus 6.

In the example embodiment shown, no additional processing machine, for example a grinding or hard lathe machine, is required for profiling the peripheral feeding surface 9, but the already existing dressing apparatus 10 can be used. This saves costs for the acquisition of the additional processing machine and reduces the handling and administrative expenditure for the profiling of the peripheral feeding surface 9 of the control wheel 8, and for the transport of the retaining apparatus 6 to the device 1.

The use of ceramic or synthetic resin-bonded control wheels eliminates externally excited vibrations, which are caused by the process in the force triangle between the grinding wheel, control wheel and support rail. Here the control wheel acts as a damping element, which enables the use of ceramic bonded grinding wheels.

In the event that the control wheel 8 and/or the peripheral feeding surface 9 is/are formed from the metal-bonded material, the concave profile can be introduced into the peripheral feeding surface 9 of the control wheel 8 by wire electrical discharge machining.

REFERENCE NUMERALS

1 Device
2 Tapered roller, rolling element
3 Lateral surface
4 Grinding apparatus
5 Concavely profiled peripheral grinding surface
6 Retaining apparatus
7 Grinding wheel
8 Control wheel
9 Convexly profiled peripheral feeding surface
10 Dressing apparatus
11 Control apparatus
50 Device from the prior art
51 Tapered roller
52 Lateral surface
53 Grinding device
54 Grinding surface
55 Hump roller

56 Hump
R1 First direction of rotation
R2 Second direction of rotation

The invention claimed is:

1. A device for producing a curved lateral surface on a rolling element for a rolling bearing, comprising:
- a grinding apparatus for grinding the curved lateral surface;
- a retaining apparatus comprising a control wheel with a convexly profiled peripheral feeding surface for retaining the rolling element during the grinding; and
- a dressing apparatus for profiling the convexly profiled peripheral feeding surface of the control wheel.

2. The device of claim 1 wherein the retaining apparatus comprises a plurality of control wheels.

3. The device of claim 1, wherein the control wheel or the convexly profiled peripheral feeding surface is formed from a ceramic, a resin-bonded synthetic, or a metallic material.

4. The device of claim 1, wherein the dressing apparatus is arranged to convexly profile the convexly profiled peripheral feeding surface.

5. The device of claim 1 further comprising a control apparatus for controlling the dressing apparatus.

6. The device of claim 1, wherein the grinding apparatus is a grinding wheel with a concavely profiled peripheral grinding surface.

7. A device for producing a curved lateral surface on a rolling element for a rolling bearing, comprising:
- a grinding wheel with a concavely profiled peripheral grinding surface for grinding the curved lateral surface;
- a retaining apparatus comprising a control wheel with a convexly profiled peripheral feeding surface for retaining the rolling element during the grinding; and
- a dressing apparatus for:
  - sharpening or calibrating the concavely profiled peripheral grinding surface;
  - profiling the concavely profiled peripheral grinding surface; or
  - profiling the convexly profiled peripheral feeding surface.

8. The device of claim 7, wherein the dressing apparatus is arranged to:
- concavely profile the concavely profiled peripheral grinding surface; or
- convexly profile the convexly profiled peripheral feeding surface.

9. The device of claim 7 further comprising a control apparatus for controlling the dressing apparatus.

10. A method for producing a curved lateral surface on a rolling element for a rolling bearing comprising:
- providing the device of claim 1;
- arranging the rolling element on the convexly profiled peripheral feeding surface;
- grinding the curved lateral surface; and
- processing or convexly profiling the convexly profiled peripheral feeding surface with the dressing apparatus.

11. The method of claim 10, further comprising:
- providing a control apparatus; and
- controlling the dressing apparatus with the control apparatus to convexly profile the convexly profiled peripheral feeding surface.

12. The method of claim 10, wherein the processing or convexly profiling the convexly profiled peripheral feeding surface with the dressing apparatus comprises wire electrical discharge machining.

* * * * *